United States Patent [19]

Walters

[11] Patent Number: 4,887,586

[45] Date of Patent: Dec. 19, 1989

[54] HEAT RECOVERY APPARATUS

[76] Inventor: Lonnie D. Walters, 6410 Highbury St., Dayton, Ohio 45424

[21] Appl. No.: 332,520

[22] Filed: Dec. 21, 1981

[51] Int. Cl.[4] ..... F24D 9/00

[52] U.S. Cl. ..... 126/101; 122/20 B; 237/55

[58] Field of Search ..... 237/55; 122/20 B; 126/101; 165/DIG. 2

[56] References Cited

U.S. PATENT DOCUMENTS

| | | | |
|---|---|---|---|
| 568,852 | 10/1896 | Johns | 122/20 B |
| 602,722 | 4/1898 | Boyes | 122/20 B |
| 2,619,022 | 11/1952 | Hergenrother | 237/55 |
| 3,793,992 | 2/1974 | Marquez | 122/20 B |
| 4,178,907 | 12/1979 | Sweat | 237/55 |
| 4,244,326 | 1/1981 | Jackson | 122/20 B |
| 4,251,028 | 2/1981 | Nicolai | 122/20 B |
| 4,371,111 | 2/1983 | Pernosky | 237/55 |

FOREIGN PATENT DOCUMENTS

| | | | |
|---|---|---|---|
| 671479 | 1/1939 | Fed. Rep. of Germany | 122/20 B |
| 2750889 | 5/1979 | Fed. Rep. of Germany . | |
| 2757961 | 6/1979 | Fed. Rep. of Germany | 237/55 |
| 2019987 | 11/1979 | United Kingdom | 237/55 |

*Primary Examiner*—Larry Jones

*Attorney, Agent, or Firm*—Jerome P. Bloom

[57] ABSTRACT

Apparatus utilizing waste heat from a furnace or the like to heat water for any desired purpose or to supplement a conventional heating system. In its illustrative embodiment, the invention provides a heat recovery device adapted to be interposed as a unit in a flue duct to absorb heat from the hot gases and products of combustion escaping through the flue duct, connections being provided for a positive, controlled flow of a heat absorbing liquid through the device. The device includes an inner flue section, a liquid flow coil around the flue section and an outer sleeve relatively insulated from heated components and joining the parts into a device capable of being stored, handled and installed as a unit.

12 Claims, 1 Drawing Sheet

HEAT RECOVERY APPARATUS

BACKGROUND OF THE INVENTION

Figure 1:
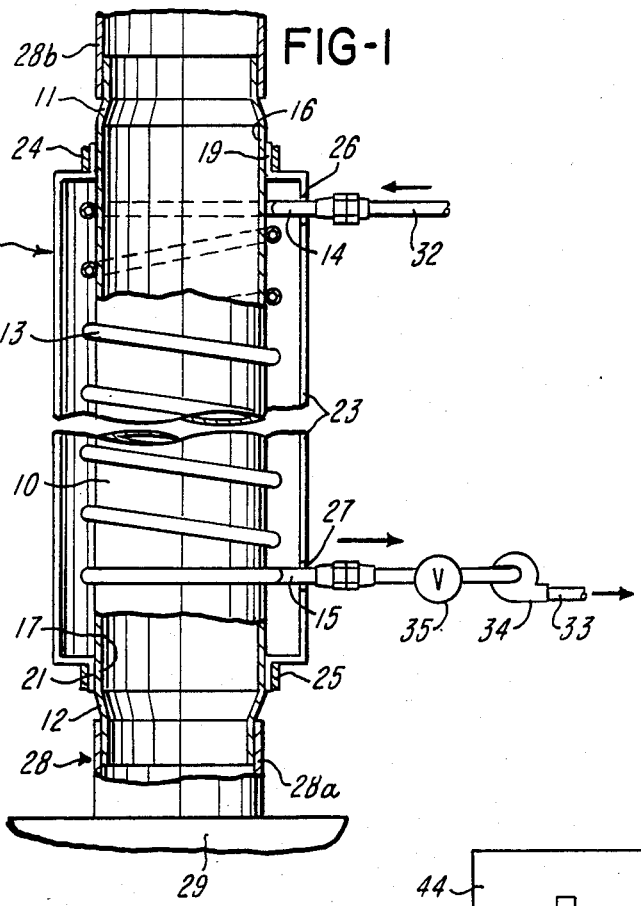

This invention relates to the utilization of waste heat, and particularly to a heat recovery device for interposing in a flue duct carrying off hot gases and products of combustion from a furnace or the like.

I am aware of examples of heat recovery devices in the prior art, for example water heater accessories as shown in Goldhagen No. 1,865,852 and Marquez No. 3,793,992. In the instance of the former example, a coil for circulation of water to be heated is positioned within a flue section adapted to be inserted in a furnace flue duct. The interior location of the water coil is hazardous since a leaking coil can extinguish the furnace flame and allow an accumulation of unburned gas or oil. In addition, products of combustion depositing on the coil create a layer of insulation causing a steadily decreasing level of heat transfer efficiency. In the instance of the latter example, that is, Marquez 3,793,992, the water coil is external to the flue duct but is nested in an insulating material. Application of the coil is to an existing flue duct, and not to a flue section which is an integral part of the device. Heat transfer efficiency accordingly varies with the aptitude of the installer and with multiple tolerances as represented by the flue duct diameter, coil tubing diameter and the depth of coil accommodating grooves in the insulator. Just how the reference device is applied is unclear, but it has no existence as a device capable of being handled, stored and installed as a unit in to become a part of a flue duct.

SUMMARY OF THE INVENTION

A heat recovery device in accordance with the present invention is, in an exemplary embodiment, a unitary article of manufacture comprised of an inner flue section, a water coil wrapped to the exterior of the inner flue section, and an outer sleeve joining at its opposite ends to the inner flue section, and, intermediate its ends, being spaced from the coil. Projecting ends of the inner flue section are adapted to telescopic engagement with open, separated ends of a flue duct, the device lending itself readily to unitary storing, handling and installation in a flue duct to be a part of the duct. The water coil being external to the inner flue section, the device is not subject to the disadvantages of an internal coil construction of the Goldhagen type. The unitary, three-part construction of the invention device distinguishes it from Marquez, as does the ability of the device to achieve intimate, uniform contact of the coil with the inner flue section, and the ability to achieve an insulated construction without need for molded structures which do not adapt easily to a flue duct and are variously effective in enforcing coil contact with the flue duct. Obvious cost advantages result, moreover, from the present fabricated device.

An object of the invention is to provide a heat recovery device structurally characterized by a threepart construction in which an inner flue section is surrounded by a coil of tubing which is in turn surrounded by and radially spaced from an outer sleeve.

Another object of the invention is to join the parts of the recovery device into a unitary assembly, stored, handled and installed in a flue duct as one piece.

A further object of the invention is to provide a heat recovery device generally applicable to water heating systems and to supplemental space heating systems.

Still another object of the invention is to provide a simple and efficient device for recapturing waste heat from a flue duct and making it available for water heating and like purposes.

Figure 2:
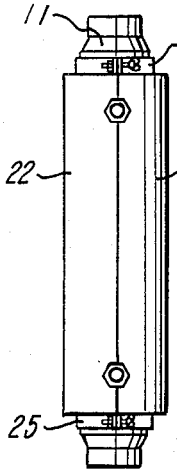
Figure 3:
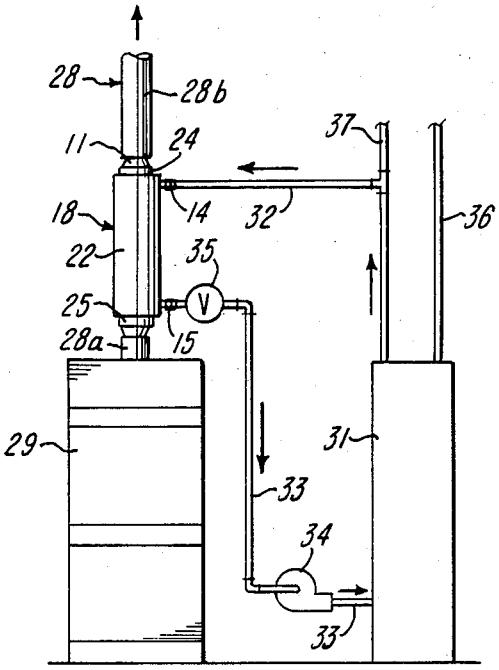
Figure 4:
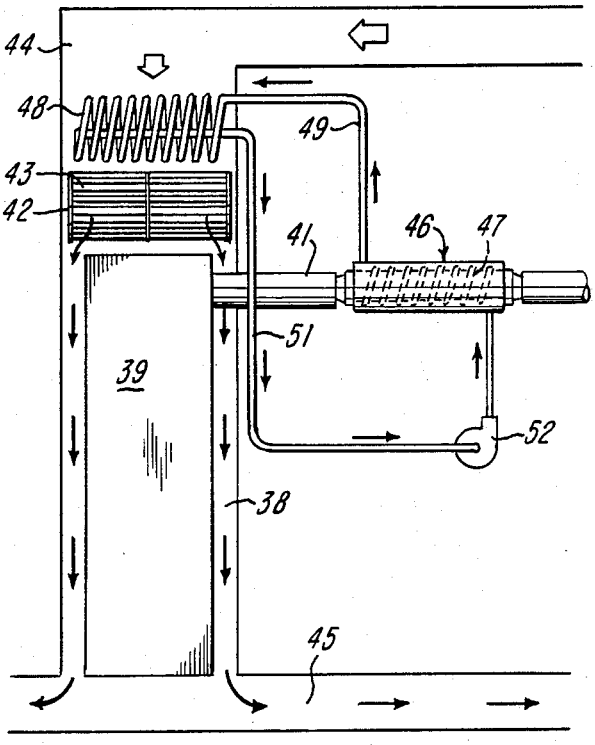

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents. Referring to the accompanying drawing wherein is shown one but obviously not necessarily the only form of embodiment of the invention, FIG. 1 is a view in longitudinal section, and partly diagrammatic, of a heat recovery device in accordance with the illustrated embodiment of the invention;

FIG. 2 is an elevational view, at a relatively reduced scale, of the heat recovery device;

FIG. 3 is a diagram showing the device of FIGS. 1 and 2 in a hot water heating system; and FIG. 4 is a diagram showing the heat recovery device applied for pre-heat purposes in a warm air circulating furnace. Referring to the drawings, a heat recovery device according to the illustrative embodiment comprises concentric parts including an elongated central cylindrical part 10, which will hereinafter be termed an inner flue section since in an installed position of the device it functions as an inserted section of a flue duct. The inner flue section is made of a material of good heat conductivity, for example a thin, lightweight sheet metal. Opposite ends are formed with tapers 11 and 12 which facilitate a telescopic engagement with open, separated ends of a flue duct. A helical coil of tubing 13 is wrapped around the exterior of inner flue section 10, and, in any appropriate manner, is caused to have a close, intimate contact with the metal wall which defines the part 10. Tubing 13 is made of a relatively ductile metal of good heat conductivity, for example copper, and the formed coil extends over a major part of the length of the flue section. Opposite ends 14 and 15 of the tubing project substantially tangentially of the flue section, being adapted, as will hereinafter more clearly appear, to be connected in a system circulating a liquid to be heated. The coil 13 is centrally positioned along the length of flue section 10 and terminates short of opposite ends thereof to leave lands 16 and 17 respectively adjacent tapered portions 11 and 12.

A tubular sleeve 18 surrounds inner flue section 10 and coil 13. It has a length less than the length of inner flue section 10 but greater than the length of coil 13 and has a diameter intermediate its ends exceeding that of coil 13. The outer sleeve 18 is accordingly spaced from coil 13 in both longitudinal and radial senses and is effectively insulated therefrom. At each of its opposite extremities, the sleeve 18 is inturned toward the inner flue section and formed further with a projecting flange or collar, 19 and 21 respectively, adapted to engage against a respective land 16 and 17. The area of contact of collars 19 and 21 with flue section 17 is minimal, considering the overall length of the outer sleeve, major portions of the sleeve being accordingly also insulated from the inner flue section.

For convenience, sleeve 18 is described as though it were of one piece construction. As a matter of manufacturing and assembly expedience, however, it is in the illustrated instance made of mating semi-cylindrical parts 22 and 23, composite arcuate projections forming the collars 19 and 21. Screw clamps 24 and 25 (FIG. 2) fitting around respective collars 19 and 21, hold the two part structure together and fix the sleeve so defined to the inner flue section 10. Sleeve part 23 has longitudinally spaced apart apertures 26 and 27 to accommodate the projection therethrough of coil terminals 14 and 15, rimmed by seals.

In diagrammatic illustration, as shown in FIG. 3, a heat recovery device as disclosed replaces a section of a flue duct 28 rising from a furnace 29. Taper portions 11 and 12 interfit with duct sections 28*a* and 28*b*, and inner flue section 10 becomes an integral part of the flue duct by which hot gases and the products of combustion escape from furnace 29. Flue section 10 is heated thereby and conducted heat is absorbed through the walls of tubing 13 into contained liquid therein. The tubing 13 is, as noted, in good heat transfer contact with the exterior wall of flue section 10 and, if desired, this contact may be enhanced by brazing or soldering the coils to the flue section wall. In the illustrated instance, the liquid in the coil is water drawn from and returned to a storage tank 31. Terminal 14 may be regarded as the inlet to coil 13 and connects to a line 32 leading from tank 31. Terminal 15 serves as the coil outlet and connects to a line 33 leading back to the storage tank. In line 33 is a pump 34 and a valve 35, the former insuring a positive circulation of water through the coil and the latter being settable to regulate the rate of water flow. Operation of pump 34 can be made dependent upon and responsive to operation of the furnace 29. Tank 31 is connected to a water source by a line 36 and demands upon the heated water therein are met through a discharge line 37. The tank 31 can be a conventional hot water heater in which the instant heat recovery system reduces the need for direct energy consumption. It might also serve as a hot water reservoir or plenum chamber in any system having heated water requirements, as for example, baseboard room heating.

In all such systems, use and operation of the heat recovery device would be substantially the same. Water to be heated enters coil 13 at its upper terminal 14 and travels through successively lower layers of the coil until emerging from terminal 15. In the process, the flowing water is in a heat transfer relation, through the coil tubing and through the wall of flue section 10, with hot gases and products of combustion which issue from the furnace 29 and are allowed to rise through the flue duct 28, including interposed flue section 10. The arrangement places the flowing water and the moving heat source in an essentially counterflow relation for maximum heat transfer benefits. Movement of water through the coil does not rely upon gravity forces but is a positive action and forced by pump 34. If it should be found desirable to vary the rate of water flow this can be done through an appropriate adjustment of valve 35. The coil 13, being on the exterior of flue section 10, is not exposed to direct contact with the products of combustion and is, moreover, protected within the outer sleeve 18. It can accordingly function at a uniform rate of efficiency and is protected from damage from external sources. The sleeve 18 is insulated from coil 13, and, to a large extent, from flue section 10 also in a manner to reduce heat loss and to simplify handling and servicing. A lower part of the tubular sleeve may be apertured so that leakage from the coil can be readily detected. The two part construction of the tubular sleeve allows the recovery device to be easily and quickly assembled and disassembled for simplified servicing and initial fabrication.

FIG. 4 shows in diagrammatic form a portion of a warm air circulating system in which a heat recovery unit per the invention is applied in a pre-heating of furnace return air. Pre-heating will, of course, result in a fuel saving as the work load to be performed by the furnace is reduced, with a corresponding reduction in fuel consumption. As indicated in the drawing, a furnace 38 encloses a burner compartment 39 from which hot gases and products of combustion escape by way of a flue 41. The furnace 38 has a superstructure rising above compartment 39 which provides an interior chamber 42. The latter houses a blower 43 and communicates with a duct 44 by which relatively cold air from the space to be heated and/or outside air is conducted to the furnace. Blower 43 draws the relatively cold air into chamber 42 and forces it over and around the burner compartment 39 and into a duct 45 by which the now heated air is conducted to the space or spaces to be heated.

A heat recovery device 46, which is the same as the device of FIG. 1, is installed in the flue 41 to absorb heat from the hot gases and products of combustion exiting the furnace 38. Coil 47, of the device 46, is included in a closed liquid loop which further includes a similar coil 48, made of a good heat conductive material, such as copper, and so located in or adjacent to the furnace that cold air returning by way of duct 44 must pass over coil 48 in the process of being drawn into chamber 42. Flow from coil 47 to coil 48 is by way of a line 49 and flow from coil 48 back to coil 47 is by way of a line 51. Water, or another suitable liquid, substantially fills the circuit comprising coils 47 and 48 and lines 49 and 51 and circulates therein under the influence of a pump 52. As will be understood, the circulating liquid absorbs heat in coil 47 and, in coil 48, transfers the acquired heat to the relatively cold air entering chamber 42. As noted, in so pre-heating the return air, prior to its being passed over the burner compartment 39, the heat recovery system of the invention substantially reduces the work load placed upon the furnace in achieving whatever temperature levels it may be called on to provide.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Heat recovery apparatus comprising a tubular element the interior surface of which defines an unobstructed flow passage, said element being structured at its opposite ends to facilitate its installation to form a part of ductwork through which products of combustion and/or other fluid embodying heat energy may escape from a furnace or the like, a helical coil of tubing wrapped around the exterior of said tubular element in heat transfer contact therewith, opposite ends of said tubing being projected to serve respectively as the inlet for fluid which is to be heated in passage therethrough and the outlet for the delivery of the so heated fluid therefrom, a protective shell surrounding and capping said coil of tubing and positioned in a circumferentially and substantially equidistantly end spaced relation thereto, said shell being apertured for projection therethrough of said opposite ends of said tubing to be connected with and form a part of a fluid handling and conditioning system, said tubular element being elongated relative to and extending beyond the respective ends of said protective shell, the respective ends of said shell being secured to and about said tubular element relatively adjacent its ends to form with said tubular element and that portion of the coil capped and contained thereby a unitary heat recovery device which may be inserted to form a part of new or existing ductwork through which products of combustion and/or other fluid embodying heat energy may flow and in the course of its flow move to and through said tubular element in heat transfer relation to such fluid as may be passing through said coil.

2. A heat recovery system including the apparatus of claim 1 and further comprising a pump, said pump being connected to said inlet to deliver thereto a forced flow of fluid which is passed through said coil in heat transfer relation to such fluid as may be moving through said tubular element and a valve associated with said tubing settable to vary the flow of fluid through said coil independently of said pump.

3. Apparatus according to claim 1 wherein said coil of tubing is substantially centrally positioned along the length of said tubular element within the limits of said shell and in intimate contact with an extended portion of the exterior wall surface of said tubular element.

4. Heat recovery apparatus according to claim 1, embodied in connection with a warm air circulating furnace in which a pre-heater is installed in the path of flow of relatively cold air to the furnace, said pre-heater being included in a liquid flow circuit further including said heat recovery apparatus installed in the furnace flue.

5. Heat recovery apparatus according to claim 4, the liquid flow circuit comprising said preheater and said heat recovery apparatus providing interconnecting flow lines and forming a closed liquid loop, said circuit still further providing a pump for the positive circulation of liquid in said loop from said heat recovery apparatus to said pre-heater and back again.

6. Heat recovery apparatus according to claim 5 wherein said pre-heater is a hollow coil forming part of said liquid loop.

7. Apparatus according to claim 1, said tubular element having offset end portions formed for a telescopic interengagement thereof with, between and in bridging relation to sections of said ductwork to which it applies and land portions adjacent said offset end portions defining longitudinally spaced apart locations thereon to which the said respective ends of said shell are secured.

8. Heat recovery apparatus including a flue section, said flue section being structured at its opposite ends to facilitate its installation in ductwork through which products of combustion and/or other fluid embodying heat energy may escape from a furnace or the like, a helical coil of tubing wrapped around the exterior of said flue section in heat transfer contact therewith, opposite ends of said tubing being projected to serve respectively as the inlet and the outlet for fluid which is to be heated in passage therethrough, a protective shell surrounding said coil of tubing and positioning in a circumferentially and end spaced relation thereto, said shell being apertured for projection of said tubing ends therethrough to be connected with and form part of a fluid handling and conditioning system, said flue section being elongated relative to and extending beyond the respective ends of said protective shell beyond said coil of tubing, and said protective shell having the respective ends thereof attached to said flue section short of said opposite ends thereof to provide thereby a simple, highly efficient heat recovery device adapted for simplified installation in new and existing ductwork, said protective shell providing a surface relatively free of contact with heat transfer surfaces for handling of the assembly comprising said flue section, said coil of tubing, and said shell, said assembly constituting a unitary heat recovery device, and said shell being apertured at a location to evidence any leakage that may occur in use of said coil, the construction and arrangment of said shell, said coil and the tubing of which it forms a part being such to preclude fluid leakage therefrom, if any, from reaching the interior of said flue section.

9. Apparatus according to claim 8 wherein said protective shell has a longitudinally split construction and means are included which secure said split portions thereof together, about and in circumferentially and end spaced capping relation to said coil and end portions of said shell to and about portions of said fuel section adjacent and spaced from its ends.

10. Apparatus according to claim 8 wherein the ends of said wrapped coil of tubing extend generally tangentially of said tubular member and project through and beyond said shell for the connection of said coil and that unitary heat recovery device of which it forms a part to that system to which it applies.

11. Apparatus according to claim 10, said wrapped coil of tubing being metallurgically bonded to said inner flue section.

12. Heat transfer apparatus comprising a tubular element the interior surface of which defines an unobstructed flow passage, said element being structured at its opposite ends to facilitate its installation in ductwork through which a heat transfer fluid may flow, a helical coil of tubing uniformly and intimately wrapped around the exterior of said tubular element in heat transfer contact therewith, opposite ends of said tubing being projected to serve respectively as the inlet for fluid to be subjected to heat transfer in passage therethrough and the outlet for the delivery of the resultingly conditioned fluid which issues therefrom, a protective shell surrounding and capping said coil of tubing and positioned in a circumferentially and end spaced relation thereto, said shell being apertured for projection therethrough of said opposite ends of said tubing to be connected with and form a part of a fluid handling and conditioning system, said tubular element being elongated relative to and extending through and beyond the respective ends of said protective shell which are longitudinally spaced from the respective ends of the coil which it caps, the respective ends of said shell being secured to and about said tubular element short of its ends to form with said tubular element and that portion of the coil capped and contained thereby a unitary heat recovery device which may be inserted to form a part of new or existing ductwork through which a temperature conditioning fluid may pass and in the course of its flow move to and through said tubular element in heat transfer relation to such fluid as may be passing through said coil and said shell being apertured at a location to evidence any leakage that may occur in use of said coil.

* * * * *